US009635446B2

(12) United States Patent
Won

(10) Patent No.: US 9,635,446 B2
(45) Date of Patent: Apr. 25, 2017

(54) SPEAKER FRAME AND SPEAKER HAVING THE SAME

(71) Applicant: Sung Ju & Solution Co., LTD, Gyeonggi-do (KR)

(72) Inventor: Jong-Dae Won, Gyeonggi-do (KR)

(73) Assignee: SUNG JU & SOLUTION CO., LTD, Gyeonggi-Do (KR)

( * ) Notice: Subject to any disclaimer, the term of this patent is extended or adjusted under 35 U.S.C. 154(b) by 74 days.

(21) Appl. No.: 14/377,176

(22) PCT Filed: Sep. 25, 2013

(86) PCT No.: PCT/KR2013/008576

§ 371 (c)(1),
(2) Date: Aug. 7, 2014

(87) PCT Pub. No.: WO2014/051330

PCT Pub. Date: Apr. 3, 2014

(65) Prior Publication Data

US 2016/0261966 A1 Sep. 8, 2016

(30) Foreign Application Priority Data

Sep. 25, 2012 (KR) ..... 10-2012-0106520

(51) Int. Cl.
*H04R 1/06* (2006.01)
*H04R 9/06* (2006.01)
(Continued)

(52) U.S. Cl.
CPC ..... *H04R 1/06* (2013.01); *H04R 1/025* (2013.01); *H04R 9/025* (2013.01); *H04R 9/043* (2013.01);
(Continued)

(58) Field of Classification Search
CPC . H04R 1/06; H04R 9/06; H04R 9/043; H04R 2400/11; H04R 31/006
See application file for complete search history.

(56) References Cited

U.S. PATENT DOCUMENTS 6,700,988 B2 * 3/2004 Wu ..... H04R 1/06 181/171
8,295,538 B2 * 10/2012 Harris ..... H04R 9/043 264/104
(Continued)

FOREIGN PATENT DOCUMENTS

JP 08-275291 A 10/1996
JP 2001-211499 8/2001
(Continued)

*Primary Examiner* — Matthew Eason
(74) *Attorney, Agent, or Firm* — Mark M. Friedman

(57) ABSTRACT

There are provided a speaker frame having a metallic suspension integrated therewith, the suspension being connected to a voice coil unit to transmit electrical signals thereto and supporting the voice coil unit to vibrate in place according to the electrical signals, and a speaker having the speaker frame. The speaker frame forms a casing of the speaker and including elements of the speaker creating sound according to the electrical signals. The metallic suspension may be integrated with the speaker frame by injection molding of a synthetic resin, and a process of installing the suspension in the speaker frame may be omitted in the assembly process of the speaker. Therefore, manufacturing time and costs of the speaker may be reduced.

12 Claims, 8 Drawing Sheets

(51) Int. Cl.

| | |
|---|---|
| ***H04R 1/02*** | (2006.01) |
| ***H04R 31/00*** | (2006.01) |
| ***H04R 9/02*** | (2006.01) |
| ***H04R 9/04*** | (2006.01) |

(52) U.S. Cl.
CPC ..... *H04R 9/045* (2013.01); *H04R 9/046* (2013.01); *H04R 9/06* (2013.01); *H04R 31/003* (2013.01); *H04R 2307/204* (2013.01); *H04R 2400/11* (2013.01)

(56) References Cited

U.S. PATENT DOCUMENTS

| | | | | |
|---|---|---|---|---|
| 8,311,263 | B2 * | 11/2012 | Huang | H04R 7/20 381/403 |
| 9,277,305 | B2 * | 3/2016 | Kwon | H04R 7/10 |
| 9,301,053 | B2 * | 3/2016 | Guo | H04R 9/04 |
| 2003/0185415 | A1 * | 10/2003 | Funahashi | H04R 9/043 381/398 |
| 2004/0001603 | A1 * | 1/2004 | Sahyoun | H04R 1/06 381/404 |
| 2005/0018869 | A1 * | 1/2005 | Ajiki | H04R 9/066 381/394 |
| 2005/0147272 | A1 * | 7/2005 | Hyre | H04R 9/06 381/398 |
| 2005/0201588 | A1 * | 9/2005 | Funahashi | H04R 7/26 381/423 |
| 2006/0098838 | A1 * | 5/2006 | Yoo | H04R 1/06 381/398 |
| 2014/0056463 | A1 * | 2/2014 | Kim | H04R 9/043 381/398 |
| 2016/0173990 | A1 * | 6/2016 | Park | H04R 1/06 381/354 |

FOREIGN PATENT DOCUMENTS

| | | |
|---|---|---|
| JP | 2006-191252 | 7/2006 |
| KR | 10-1112130 | 2/2012 |

* cited by examiner

SPEAKER FRAME AND SPEAKER HAVING THE SAME

TECHNICAL FIELD

The present disclosure relates to a speaker frame forming a casing of a speaker and including elements of the speaker creating sound according to electrical signals input thereto and a speaker having the same, and more particularly, to a speaker frame having a metallic suspension integrated therewith, the suspension being connected to a voice coil unit to transmit electrical signals thereto and supporting the voice coil unit to vibrate in place according to the electrical signals, and a speaker having the speaker frame.

BACKGROUND ART

A speaker is a device converting electrical signals generated by a signal input source such as an amp or the like into sound waves.

Such a speaker includes a vibrating plate that is vibrated by the electrical signals input thereto. In order to vibrate the vibrating plate according to the input electrical signals, the speaker includes a voice coil receiving the input electrical signals and connected to the vibrating plate. In addition, the speaker includes a magnet creating a magnetic field.

Such a configuration creates a magnetic field around the voice coil when the electrical signals are input to the voice coil. The voice coil is vibrated by interactions between the magnetic field formed around the magnet and the magnetic field formed around the voice coil due to the electrical signals input to the voice coil. The vibrations of the voice coil cause the vibrating plate connected to the voice coil to vibrate, such that sound waves may be generated.

In order to input the electrical signals to the voice coil, a suspension electrically connected to a signal input source such as an amp or the like may be used. One end of the suspension may be electrically connected to the voice coil to allow for vibrations thereof and the other end thereof may be connected to the vibrating plate. Accordingly, the electrical signals generated by the signal input source are input to the voice coil through the suspension, and the voice coil is vibrated according to the electrical signals input thereto.

The suspension serves to transmit the electrical signals generated by the signal input source to the voice coil and also serves as a damper supporting the voice coil in order to allow the voice coil to vibrate in place.

According to the related art, the suspension is not integrated with a speaker frame forming a casing of a speaker and including the above-mentioned elements of the speaker provided therein. In this case, a speaker assembly process requires a process of installing the suspension in the speaker frame. That is, a speaker manufacturing process is increased so that manufacturing time and costs required therefor may be increased.

DISCLOSURE OF INVENTION

Technical Problem

An aspect of the present disclosure provides a speaker having reductions in manufacturing time and costs thereof.

An aspect of the present disclosure also provides a speaker frame manufactured without a process of installing a suspension therein.

An aspect of the present disclosure also provides a speaker frame having a metallic suspension integrated therewith.

Solution to Problem

According to an aspect of the present disclosure, there is provided a speaker frame forming a casing of a speaker and including elements of the speaker creating sound according to electrical signals input thereto, the speaker frame including a suspension formed of metal and integrated therewith, the suspension being connected to a voice coil unit to transmit the electrical signals thereto and supporting the voice coil unit to vibrate in place according to the electrical signals.

The speaker frame may be formed of a synthetic resin and be integrated with the suspension by injection molding of the synthetic resin.

The metal may include copper.

The suspension may include a terminal part including a terminal portion receiving the electrical signals input thereto and integrated with the speaker frame; a vibrating connection part connected to the terminal part while allowing for vibrations thereof; and a voice coil fixing part connected to the vibrating connection part and having the voice coil unit fixedly connected thereto.

The speaker frame may further include at least one support supporting the suspension so as not to be bent at the time of the injection molding of the synthetic resin.

The suspension may include a supplementary support corresponding to the at least one support.

The supplementary support may be formed on a terminal part included in the suspension.

The suspension may be divided into a positive electrode portion connected to a positive electrode of a signal input source and a negative electrode portion connected to a negative electrode of the signal input source.

According to another aspect of the present disclosure, there is provided a speaker including: the speaker frame as described above; a magnetic field forming unit provided in the speaker frame and forming a magnetic field; and a vibrating unit vibrated through interactions with the magnetic field forming unit to thereby create sound.

The magnetic field forming unit may include a yoke connected to the speaker frame; and a magnet provided in a space formed in the yoke so as to be spaced apart therefrom by a predetermined distance.

The yoke may be inserted into a yoke receiving opening formed in the speaker frame.

The vibrating unit may include the voice coil unit having one end fixedly connected to the suspension to receive the electrical signals from the suspension and the other end connected to the magnetic field forming unit; and a vibrating plate connected to the suspension to vibrate together with the voice coil unit and connected to the speaker frame while allowing for vibrations thereof.

The voice coil unit may include a coil bobbin having one end fixedly connected to the suspension and the other end disposed in a predetermined gap between a yoke and a magnet included in the magnetic field forming unit; and a voice coil wound on the coil bobbin and connected to the suspension to receive the electrical signals from the suspension.

The vibration plate may include a first vibration plate connected to the suspension; and a second vibration plate connected to the first vibration plate and the speaker frame.

Advantageous Effects of Invention

According to embodiments of the inventive concept, a speaker frame is injection-molded using a synthetic resin while having a metallic suspension integrated therewith.

According to embodiments of the inventive concept, a process of installing a suspension in a speaker frame may be omitted in the assembly process of a speaker.

According to embodiments of the inventive concept, a speaker may be manufactured with reduced manufacturing time and costs.

BRIEF DESCRIPTION OF DRAWINGS

The above and other aspects, features and other advantages of the present inventive concept will be more clearly understood from the following detailed description taken in conjunction with the accompanying drawings, in which.

MODE FOR THE INVENTION

Figure 1:
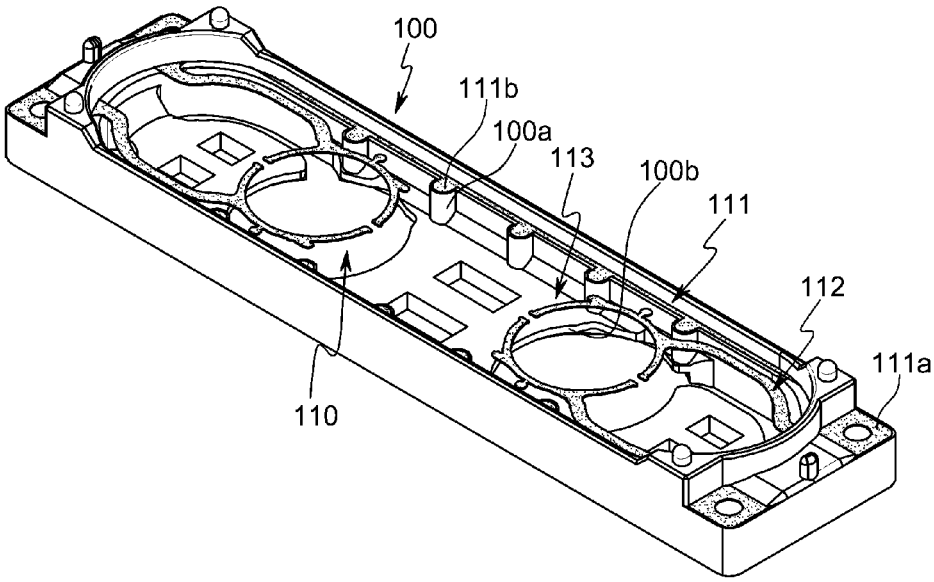
FIG. 1 is a perspective view of a speaker frame according to an embodiment of the present inventive concept.

Embodiments of the present inventive concept will now be described in detail with reference to the accompanying drawings.

The inventive concept may, however, be exemplified in many different forms and should not be construed as being limited to the specific embodiments set forth herein. Rather, these embodiments are provided so that this disclosure will be thorough and complete, and will fully convey the scope of the inventive concept to those skilled in the art.

In the drawings, the shapes and dimensions of elements may be exaggerated for clarity, and the same reference numerals will be used throughout to designate the same or like elements.

According to embodiments of the inventive concept, a suspension formed of metal may be formed to be integrated with a speaker frame, such that the suspension may be connected to a voice coil unit to transmit electrical signals thereto according to electrical signals input thereto and may support the voice coil unit to vibrate in place according to the electrical signals.

According to embodiments of the invention as illustrated in FIGS. 4 through 6 and 11, a speaker frame 100 may form a casing of a speaker 500. In addition, elements of the speaker 500 may be included in the speaker frame 100 as illustrated. For example, a suspension 110, a magnetic field forming unit 200 and a vibrating unit 300 may be provided in the speaker frame 100, such that sound may be created according to electrical signals.

Figure 2:
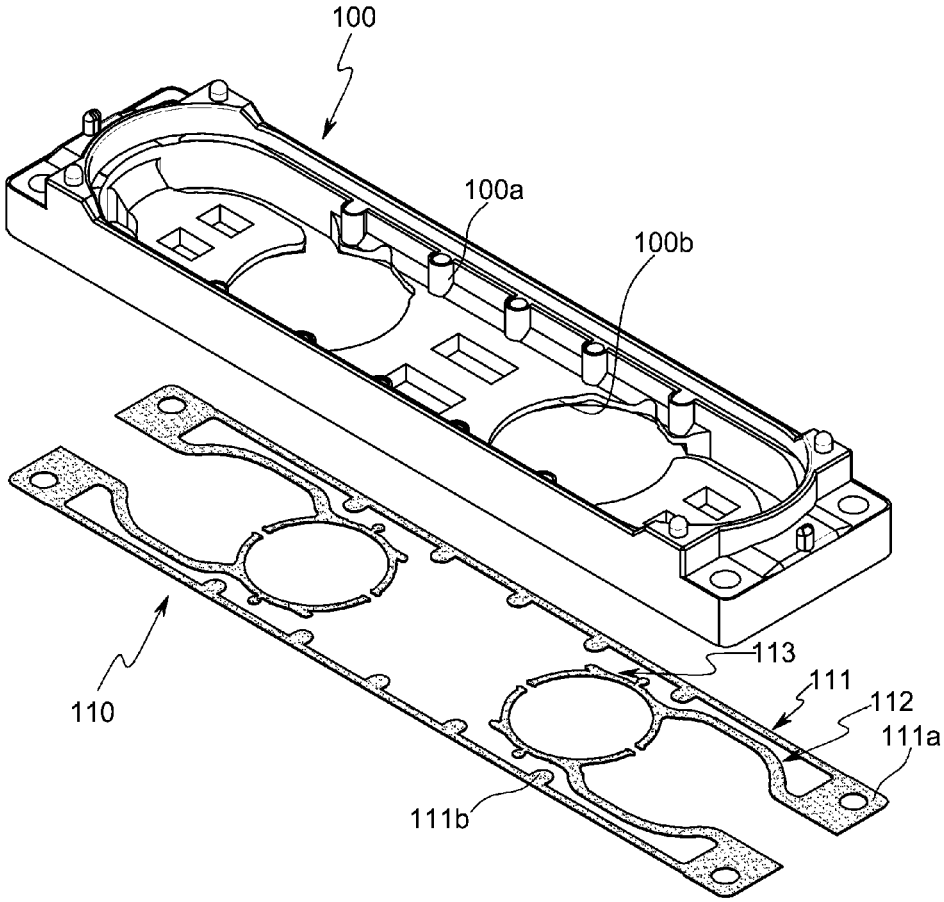
FIG. 2 is an exploded perspective view of a speaker frame before being integrated with a suspension according to an embodiment of the present inventive concept.
Figure 3:
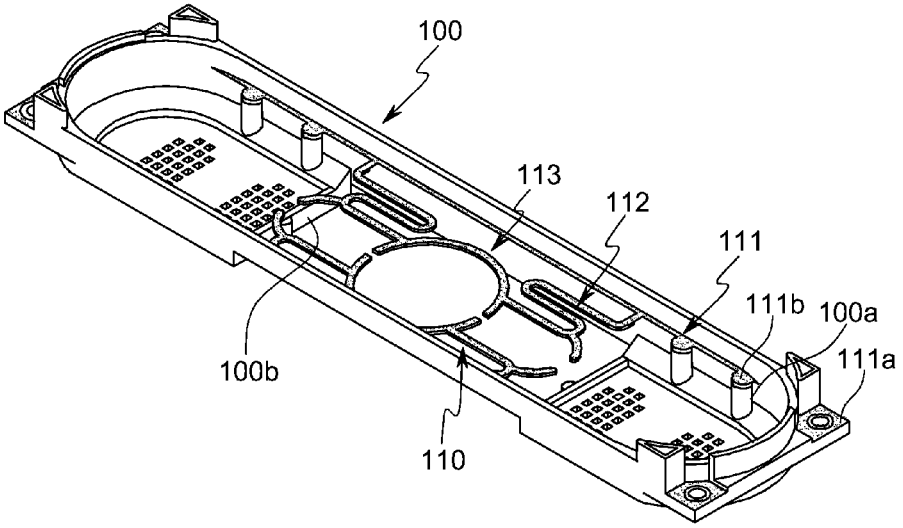
FIG. 3 is a perspective view of a speaker according to another embodiment of the present inventive concept.
Figure 4:
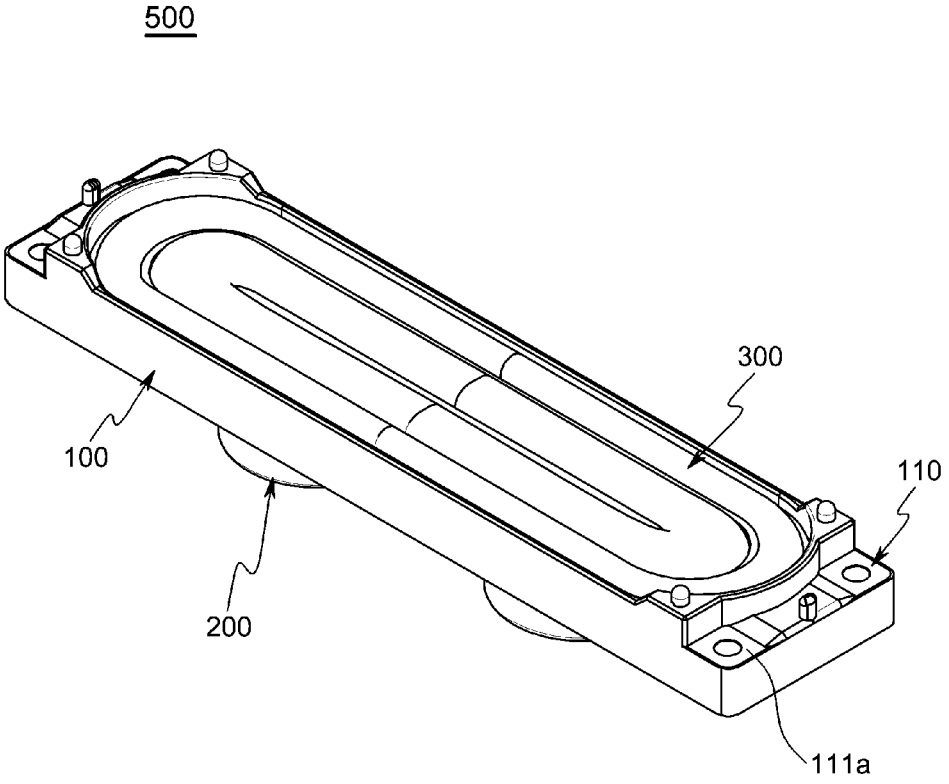
FIG. 4 is a front perspective view of a speaker according to an embodiment of the present inventive concept.
Figure 5:
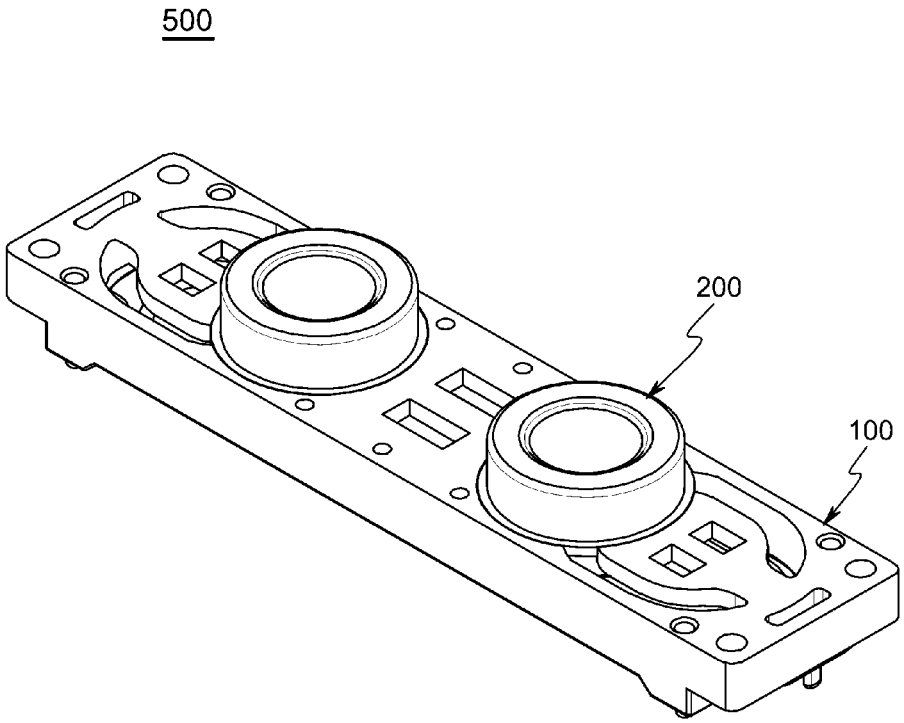
FIG. 5 is a rear perspective view of a speaker according to an embodiment of the present inventive concept.

The speaker frame 100 according to embodiments of the invention as illustrated in FIGS. 1 through 3 may be formed to be integrated with the suspension 110 formed of metal. To enable this, the speaker frame 100 may be formed of a synthetic resin. The metallic suspension 110 may be integrated with the speaker frame 100 by injection molding of the synthetic resin.

That is, in a state in which the metallic suspension 110 is placed in a mold (not shown) for injection molding of the synthetic resin, the speaker frame 100 is injection-molded using the synthetic resin, whereby the metallic suspension 110 and the speaker frame 100 may be integrated with one another.

However, the integrating of the speaker frame 100 and the metallic suspension 110 is not limited to the injection molding of the synthetic resin, but may be achieved by a method commonly known in the art.

In a case in which the metallic suspension 110 is integrated with the speaker frame 100, a process of installing the suspension 110 in the speaker frame 100 may be omitted in the assembly process of the speaker 500 illustrated in FIGS. 7 through 10. Therefore, manufacturing time and costs of the speaker 500 may be reduced.

In addition, since the suspension 110 is formed of metal, vibrations of the voice coil unit 310 fixedly connected to the suspension 110 may be facilitated. In addition, durability of the suspension 110 may be improved, whereby the suspension 110 may not be deformed or damaged even in the case in which the voice coil unit 310 is vibrated for a long period of time.

Since the suspension 110 is formed of metal, electrical signals may be transmitted to the voice coil unit 310 through the suspension 110, without the use of an additional member for transmitting the electrical signals to the voice coil unit 310.

The metal forming the suspension 110 may include copper. For example, the metal for the suspension 110 may be copper or a copper alloy. Copper has superior malleability as compared to other metals. Since the metal forming the suspension 110 includes copper, the vibrations of the voice coil unit 310 may be further facilitated as compared with a case of forming a suspension using other metals. In addition, the suspension 110 formed of copper, as compared with a suspension formed of other metals, may not be deformed or damaged even when it vibrates for a long period of time.

In addition, copper may have superior electrical conductivity as compared to other metals. Therefore, electrical signals may easily be transmitted to the voice coil unit 310 using the suspension 110 formed of copper.

Meanwhile, as shown in FIGS. 1 through 3, at least one or more supports **100*a* may be formed within the speaker frame 100. The supports 100*a* may support the suspension 110** so as not to be bent at the time of injection molding of the synthetic resin.

In addition, as shown in FIGS. 1 through 3, a yoke receiving opening **100*b* may be formed in the speaker frame 100. A yoke 210 included in the magnetic field forming unit 200 to be described below may be fitted into the yoke receiving opening 100*b* formed in the speaker frame 100. Therefore, the assembly of the speaker 500 may be facilitated as shown in FIGS. 7 through 10**.

The suspension 110 may be connected to the voice coil unit 310 such that it transmits the electrical signals input thereto to the voice coil unit 310 and allows the voice coil unit 310 to vibrate in place according to the electrical signals. To enable this, the suspension 110 may include a terminal part 111, a vibrating connection part 112 and a voice coil fixing part 113 as shown in FIGS. 1 through 3.

As shown in FIGS. 1 through 3, a terminal part 111 may include a terminal portion 111*a*. The terminal portion 111*a* may be electrically connected to a signal input source such as an amp or the like, using a wire or the like. Accordingly, the electrical signals from the signal input source such as an amp or the like may be input to the terminal portion 111*a*. In addition, the terminal part 111 may be integrated with the speaker frame 100 as shown in FIGS. 1 and 3. That is, as stated above, when the speaker frame 100 is injection-molded using the synthetic resin, the terminal part 111 of the suspension 110 may be molded to be integrated with the speaker frame 100.

As shown in FIGS. 1 and 3, the vibrating connection part 112 may be connected to the terminal part 111 while allowing for vibrations thereof. To enable this, the vibrating connection part 112 may be formed to be integrated with the terminal part 111 as illustrated, while being connected to the terminal part 111 to allow for vibrations thereof. Alternatively, the vibrating connection part 112 may be connected to the terminal part 111 by using a connection member, welding or the like, while allowing for vibrations thereof.

As shown in FIGS. 1 and 3, the voice coil fixing part 113 may be connected to the vibrating connection part 112. To enable this, the voice coil fixing part 113 may be formed to be integrated with the vibrating connection part 112 to thereby be connected thereto. Alternatively, the voice coil fixing part 113 may be connected to the vibrating connection part 112 using a connection member, welding or the like.

Figure 8:
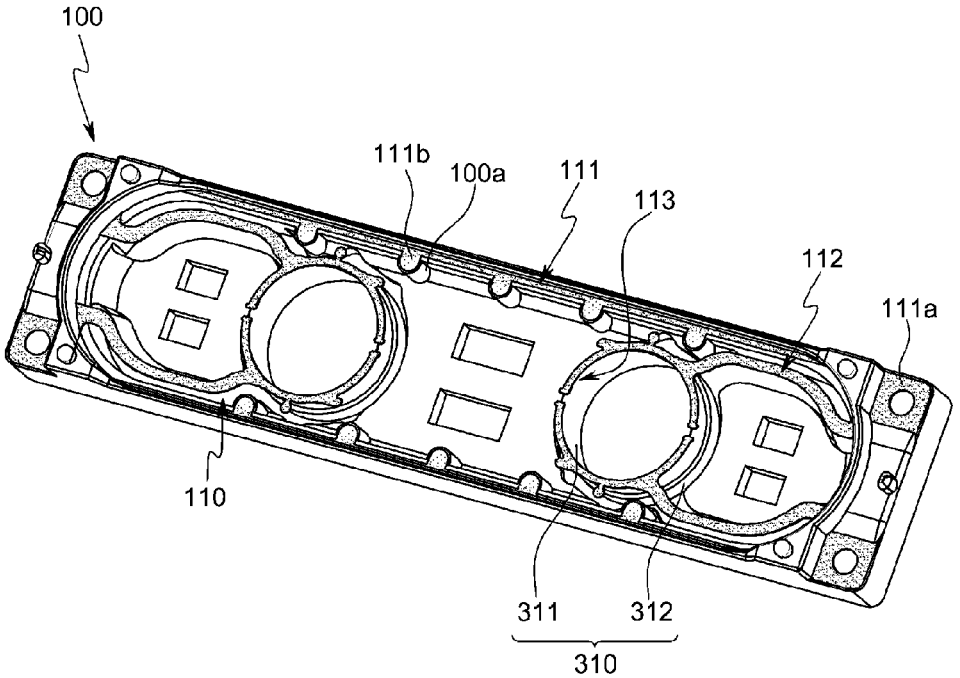

As shown in FIG. 8, the voice coil fixing part 113 may have the voice coil unit 310 fixedly connected thereto. To enable this, a shape of the voice coil fixing part 113 may correspond to that of the voice coil unit 310. For example, as shown in FIGS. 1 through 3, the voice coil fixing part 113 may have a circular shape corresponding to that of the voice coil unit 310. For example, the voice coil unit 310 may be fixedly connected to the voice coil fixing part 113 using an adhesive or the like. However, the connection of the voice coil unit 130 to the voice coil fixing part 113 is not limited thereto, and may be varied with reference to configurations well-known in the art.

As shown in FIGS. 1 and 2, the suspension 110 may include two voice coil fixing parts 113 such that two voice coil units 310 may be fixedly connected thereto. Alternatively, as shown in FIG. 3, the suspension 110 may include a single voice coil fixing part 113 such that a single voice coil unit 310 may be fixedly connected thereto. Alternatively, the suspension 110 may include three voice coil fixing parts 113 such that three voice coil units 310 may be fixedly connected thereto.

The terminal part 111, the vibrating connection part 112 and the voice coil fixing part 113 of the suspension 110 may be formed to be integrated with one another as shown in FIGS. 1 through 3. Alternatively, the terminal part 111, the vibrating connection part 112 and the voice coil fixing part 113 of the suspension 110 may be separately formed and connected to one another. Alternatively, two of the terminal part 111, the vibrating connection part 112 and the voice coil fixing part 113 of the suspension 110 may be integrated with one another and the remaining part may be separately formed and connected to the two integrated parts by using a connection member, welding, or the like.

As shown in FIGS. 1 through 3, the suspension 110 may include at least one or more supplementary supports 111*b* corresponding to the at least one or more supports 100*a* formed within the speaker frame 100. The supplementary supports 111*b* may be formed on the terminal part 111 of the suspension 110 as illustrated. A shape of the supplementary support 111*b* may correspond to that of the support 100*a* of the speaker frame 100. Accordingly, the suspension 110 may be supported by the supports 100*a* of the speaker frame 100 in order not to be bent at the time of injection molding of the synthetic resin.

In addition, as shown in FIG. 2, the suspension 110 may be divided into positive and negative electrode portions. The positive electrode portion of the suspension 110 may be connected to a positive electrode of the signal input source, and the negative electrode portion of the suspension 110 may be connected to a negative electrode of the signal input source.

According to embodiments of the invention as illustrated in FIGS. 4 through 6 and 11, the speaker 500 may include the speaker frame 100, the magnetic field forming unit 200 and the vibrating unit 300.

The configuration of the speaker frame 100 has been described above, and details thereof will be omitted.

Figure 6:
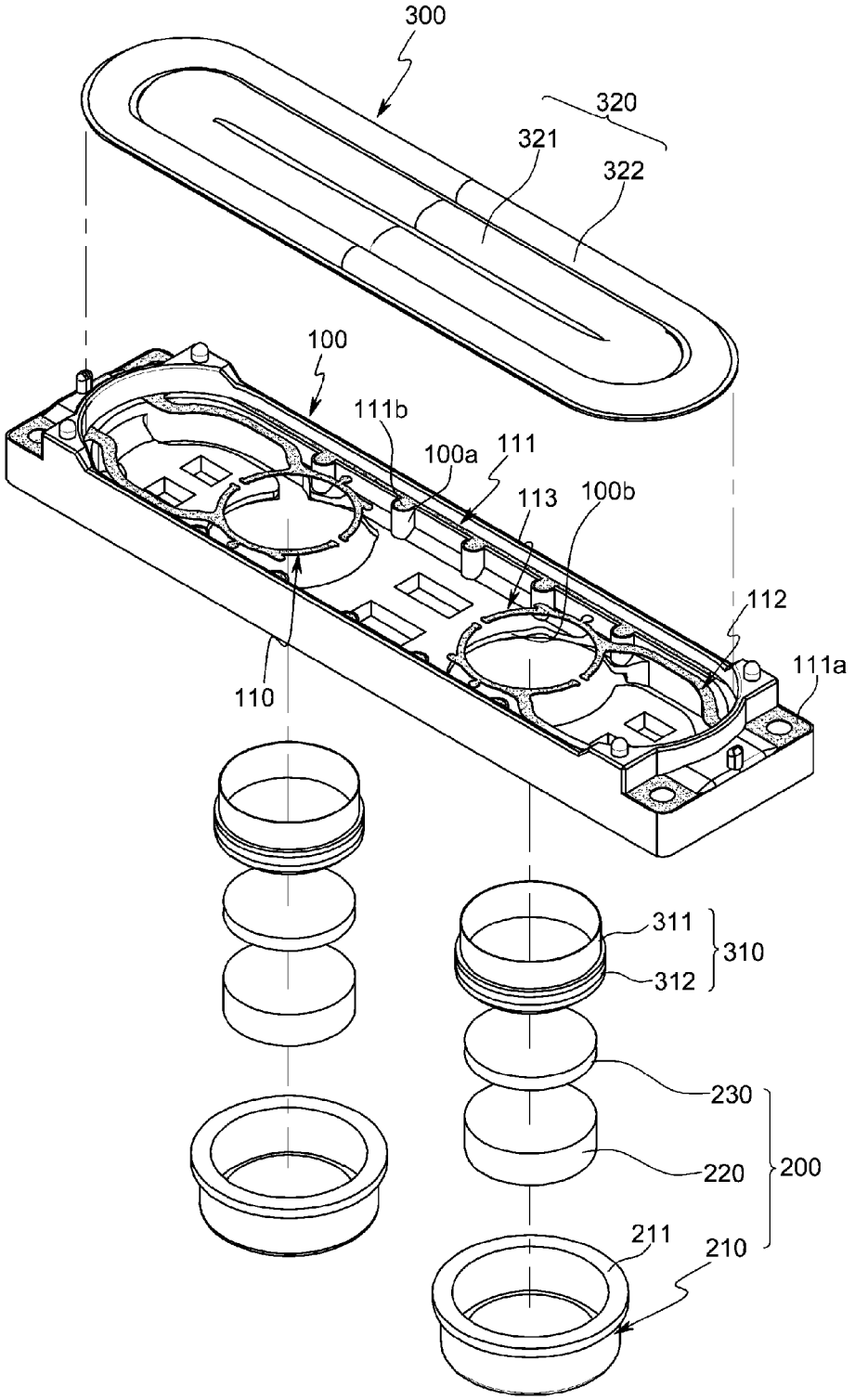
FIG. 6 is an exploded perspective view of a speaker according to an embodiment of the present inventive concept.
Figure 11:
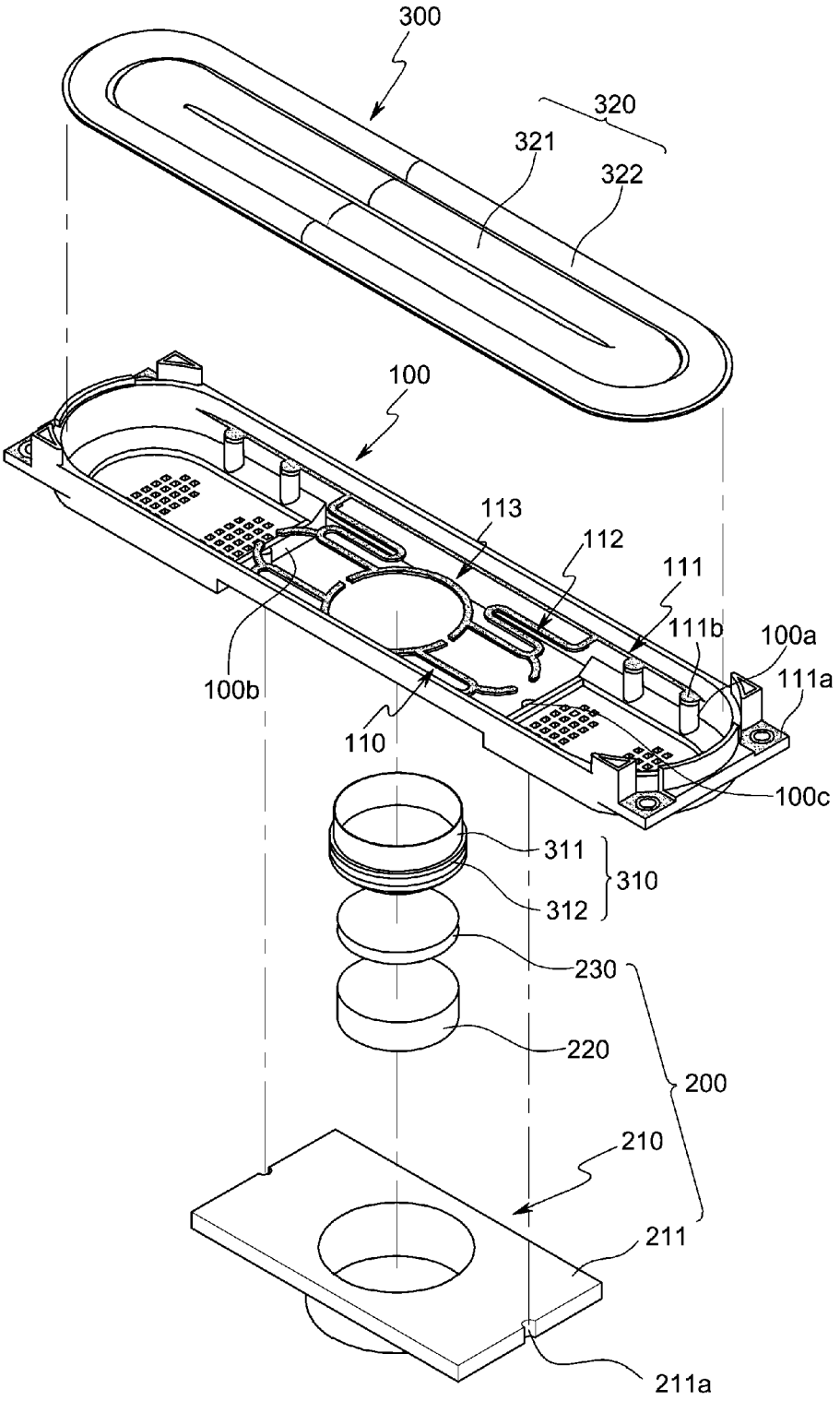
FIG. 11 is an exploded perspective view of a speaker according to another embodiment of the present inventive concept.

As shown in FIGS. 4 through 6 and 11, the magnetic field forming unit 200 may be provided in the speaker frame 100 and may form a magnetic field. To enable this, the magnetic field forming unit 200 may include the yoke 210 and a magnet 220 as shown in FIGS. 6 and 11.

The yoke 210 may be connected to the speaker frame 100. To enable this, the speaker frame 100 may have the yoke receiving opening 100*b* formed therein as shown in FIGS. 1 through 3. In addition, the yoke 210 may be fitted into the yoke receiving opening 100*b*.

For example, as shown in FIG. 6, the yoke receiving opening 100*b* of the speaker frame 100 may have a circular shape. In this case, the yoke 210 may be provided with a circular connection portion 211 inserted into the yoke receiving opening 100*b* having a circular shape.

In addition, as shown in FIG. 11, the yoke receiving opening 100*b* of the speaker frame 100 may have a quadrangular shape. In this case, the connection portion 211 of the yoke 210 may have a quadrangular shape so as to be inserted into the yoke receiving opening 100*b* having a quadrangular shape. As illustrated, the yoke receiving opening 100*b* of the speaker frame 100 may be provided with a protrusion 100*c*, and the connection portion 211 of the yoke 210 may be provided with a recess 211*a* into which the protrusion 100*c* is inserted.

However, the connection of the yoke 210 to the speaker frame 100 is not limited thereto, and may be varied with reference to configurations well-known in the art.

As shown in FIGS. 6 and 11, the magnet 220 may be disposed in a space formed within the yoke 210 so as to be spaced apart therefrom by a predetermined distance. The magnet 220 may create a magnetic field therearound. For example, the magnet 220 may be a permanent magnet. However, the magnet 220 is not limited to being a permanent magnet. Any magnet known in the art, such as an electromagnet or the like, may be used, so long as it can create a magnetic field therearound.

Meanwhile, a plate 230 may be positioned on the magnet 220 as shown in FIGS. 6 and 11.

As shown in FIGS. 4 through 6 and 11, the vibrating unit 300 may be configured to vibrate along with the magnetic field forming unit 200, and accordingly, sound may be created. To enable this, the vibrating unit 300 may include the voice coil unit 310 and a vibrating plate 320 as shown in FIGS. 6 and 11.

As shown in FIGS. 6 and 11, one end of the voice coil unit 310 may be fixedly connected to the suspension 110, and the other end thereof may be connected to the magnetic field forming unit 200. In addition, the voice coil unit 310 may receive the electrical signals from the suspension 110. The electrical signals transmitted from the suspension 110 may form the magnetic field around the voice coil unit 310. The magnetic field around the voice coil unit 310 may interact with the magnetic field formed by the magnet 220 as stated above. The vibrating plate 320 may vibrate together with the voice coil unit 310, thereby generating sound.

To enable this, the voice coil unit 310 may include a coil bobbin 311 and a voice coil 312 as shown in FIGS. 6 and 11.

One end of the coil bobbin 311 may be fixedly connected to the suspension 110 as shown in FIGS. 6 and 11. The coil bobbin 311 may be fixedly connected to the voice coil fixing part 113 of the suspension 110. For example, the coil bobbin 311 may be fixedly connected to the voice coil fixing part 113 using an adhesive or the like. However, the connection of the coil bobbin 311 to the voice coil fixing part 113 is not limited thereto, and may be varied with reference to configurations well-known in the art.

In addition, the other end of the coil bobbin 311 may be disposed in a predetermined gap between the yoke 210 and the magnet 220 of the magnetic field forming unit 200. Accordingly, the magnetic field formed around the magnet 220 may affect the coil bobbin 311.

As shown in FIGS. 6 and 11, the voice coil 312 may be wound on the coil bobbin 311. In addition, the voice coil 312 may be connected to the suspension 110 to receive the electrical signals. For example, the voice coil 312 may be electrically connected to the voice coil fixing part 113 of the suspension 110 by soldering or the like. One end of the voice coil 312 may be electrically connected to a portion of the voice coil fixing part 113 corresponding to the positive electrode portion of the suspension 110, and the other end thereof may be electrically connected to a portion of the voice coil fixing part 113 corresponding to the negative electrode portion of the suspension 110.

The voice coil 312 may receive the electrical signals from the suspension 110, such that the magnetic field may be formed around the voice coil 312. The magnetic field formed around the voice coil 312 may interact with the magnetic field formed around the magnet 220 of the magnetic field forming unit 200. Accordingly, the other end of the coil bobbin 311 disposed in the predetermined gap between the yoke 210 and the magnet 220 may be vibrated. The vibrations of the coil bobbin 311 may cause the vibrating plate 320 connected to the suspension 110 fixedly connected to one end of the coil bobbin 311 to vibrate, whereby sound may be created.

The vibrating plate 320 may be connected to the suspension 110 as shown in FIGS. 6 and 11. The vibrating plate 320 may be connected to the speaker frame 100 while allowing for vibrations thereof. Accordingly, when the voice coil unit 310 connected to the suspension 110 is vibrated, the vibrating plate 320 may vibrate together with the voice coil unit 310. As illustrated, the vibrating plate 320 may include a first vibrating plate 321 and a second vibrating plate 322.

The first vibrating plate 321 may be connected to the suspension 110 as shown in FIGS. 6 and 11. For example, the first vibrating plate 321 may be connected to an upper portion of the voice coil fixing part 113 of the suspension 110 by using an adhesive or the like, and the coil bobbin 311 of the voice coil unit 310 may be connected to a lower portion of the voice coil fixing part 113 of the suspension 110. Therefore, when the coil bobbin 311 is vibrated, the first vibrating plate 321 also vibrates together with the coil bobbin 311.

The second vibrating plate 322 may be connected to the first vibrating plate 321 and the speaker frame 100 as shown in FIGS. 6 and 11. For example, the second vibrating plate 322 may be connected to the first vibrating plate 321 and the speaker frame 100 using an adhesive or the like. As stated above, when the first vibrating plate 321 vibrates together with the coil bobbin 311 of the voice coil unit 300, the second vibrating plate 322 may also vibrate together with the first vibrating plate 321, whereby sound may be created by the vibrations of the vibrating plates.

Figure 7:
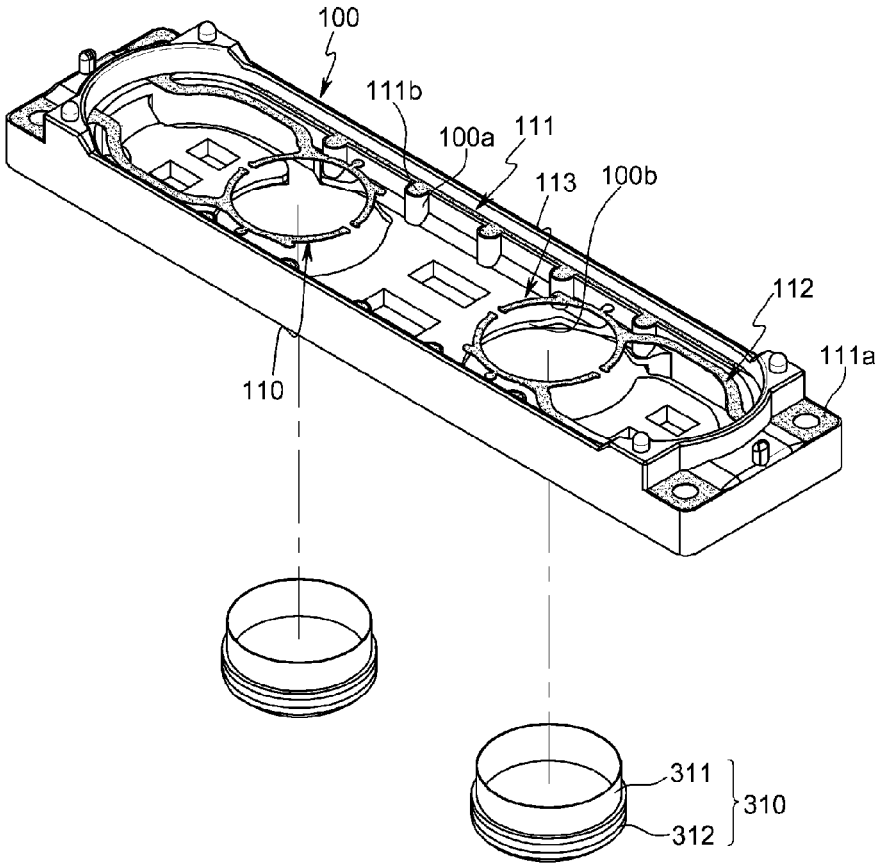
FIGS. 7 through 10 are views illustrating an assembly process of a speaker according to an embodiment of the present inventive concept.

The assembly process of the speaker 500 having the above-described configuration will be described with reference to FIGS. 7 through 10. First of all, as shown in FIG. 7, the metallic suspension 110 may be formed to be integrated with the speaker frame 100 by injection molding of a synthetic resin, and the suspension 110 of the speaker frame 100 may be connected to the voice coil unit 310 of the vibrating unit 300 using an adhesive or the like. That is, the coil bobbin 311 of the voice coil unit 310 may be fixedly connected to the voice coil fixing part 113 of the suspension 110.

Next, as shown in FIG. 8, one end of the voice coil 312 wound on the coil bobbin 311 may be connected to a portion of the voice coil fixing part 113 corresponding to the positive electrode portion of the suspension 110 by soldering or the like, and the other end thereof may be connected to a portion of the voice coil fixing part 113 corresponding to the negative electrode portion of the suspension 110 by soldering or the like.

Figure 9:
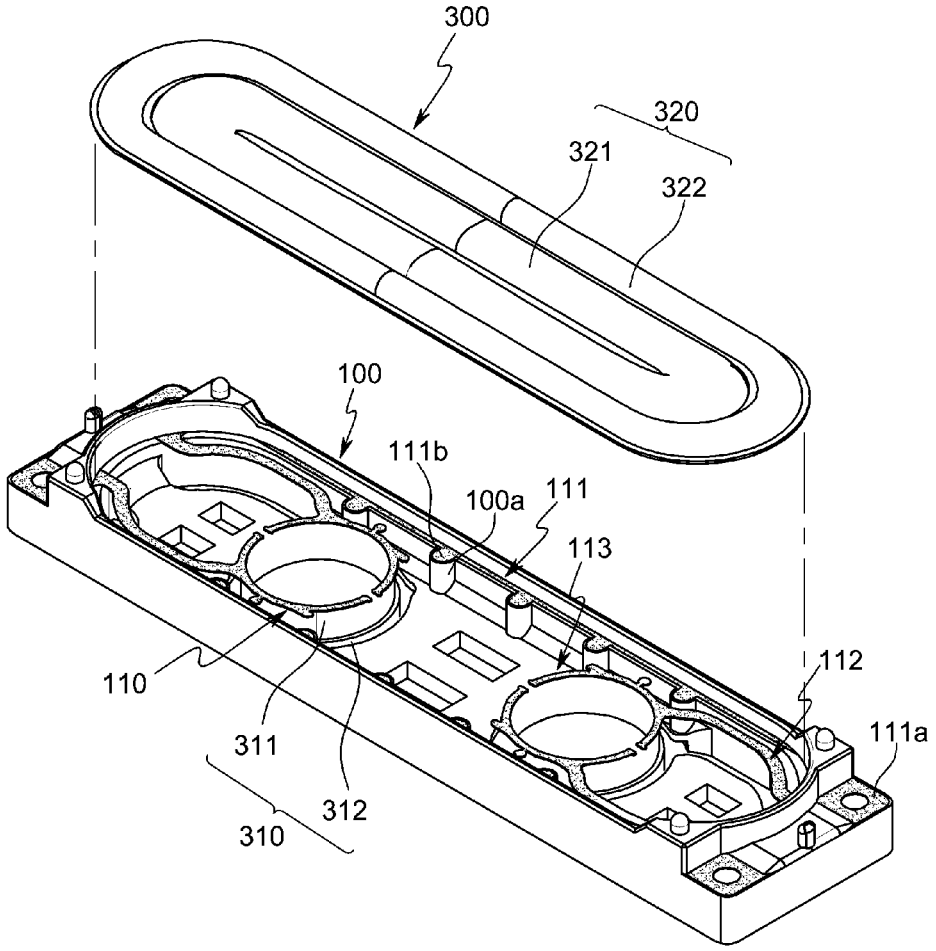

Thereafter, as shown in FIG. 9, the vibrating plate 320 of the vibrating unit 300 may be connected to the suspension 110 and the speaker frame 100 using an adhesive or the like. That is, the vibrating plate 320, having the first and second vibrating plates 321 and 322 connected to one another using an adhesive, may be connected to the voice coil fixing part 113 of the suspension 110 and the speaker frame 100.

Figure 10:
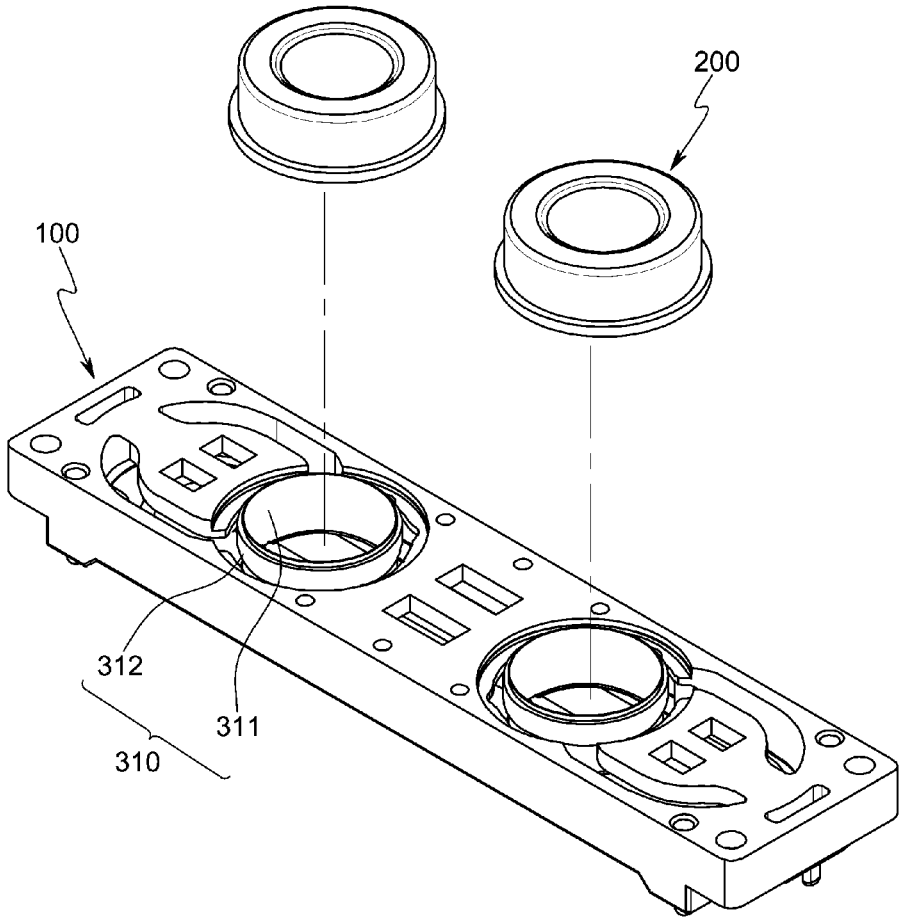

Then, the magnetic field forming unit 200 may be provided in the speaker frame 100 as shown in FIG. 10. That is, the connection portion 211 of the yoke 210 may be inserted into the yoke receiving opening **100*b* of the speaker frame 100. Here, the coil bobbin 311 of the voice coil unit 310 of the vibrating unit 300 may be positioned in a predetermined gap between the yoke 210 and the magnet 220**.

The assembly of the speaker 500 may be completed as stated above. When the speaker 500 is installed in a device such as a TV or the like, the terminal portion **111*a* of the terminal part 111 of the suspension 110 integrated with the speaker frame 100 may be electrically connected to a signal input source of the device, and thus the coil bobbin 311 may be vibrated according to electrical signals input thereto and the vibrating plate 320** may vibrate together therewith, whereby sound may be created.

In a case of using the speaker frame and the speaker according to the embodiments of the inventive concept, the metallic suspension may be integrated with the speaker frame by injection molding of the synthetic resin, and a process of installing the suspension in the speaker frame may be omitted in the assembly process of the speaker. Therefore, manufacturing time and costs of the speaker may be reduced.

As set forth above, according to embodiments of the inventive concept, a speaker frame is injection-molded using a synthetic resin while having a metallic suspension integrated therewith.

According to embodiments of the inventive concept, a process of installing a suspension in a speaker frame may be omitted in the assembly process of a speaker.

According to embodiments of the inventive concept, a speaker may be manufactured with reduced manufacturing time and costs.

While the present inventive concept has been shown and described in connection with the embodiments, it will be apparent to those skilled in the art that modifications and variations can be made without departing from the spirit and scope of the inventive concept as defined by the appended claims.

The invention claimed is:

1. A speaker frame forming a casing of a speaker and including elements of the speaker creating sound according to electrical signals input thereto, the speaker frame comprising a suspension formed of metal and integrated therewith, the suspension being connected to a voice coil unit to transmit the electrical signals thereto and supporting the voice coil unit to vibrate in place according to the electrical signals wherein the speaker frame is formed of a synthetic resin and is integrated with the suspension by injection molding of the synthetic resin, and the speaker frame further comprises at least one support supporting the suspension so as not to be bent at the time of the injection molding of the synthetic resin.

2. The speaker frame of claim 1, wherein the metal includes copper.

3. The speaker frame of claim 1, wherein the suspension comprises: a terminal part including a terminal portion receiving the electrical signals input thereto and integrated with the speaker frame; a vibrating connection part connected to the terminal part while allowing for vibrations thereof; and a voice coil fixing part connected to the vibrating connection part and having the voice coil unit fixedly connected thereto.

4. The speaker frame of claim 1, wherein the suspension comprises a supplementary support corresponding to the at least one support.

5. The speaker frame of claim 4, wherein the supplementary support is formed on a terminal part included in the suspension.

6. The speaker frame of claim 1, wherein the suspension is divided into a positive electrode portion connected to a positive electrode of a signal input source and a negative electrode portion connected to a negative electrode of the signal input source.

7. A speaker comprising: the speaker frame of claim 1; a magnetic field forming unit provided in the speaker frame and forming a magnetic field; and a vibrating unit vibrated through interactions with the magnetic field forming unit to thereby create sound.

8. The speaker of claim 7, wherein the magnetic field forming unit comprises: a yoke connected to the speaker frame; and a magnet provided in a space formed in the yoke so as to be spaced apart therefrom by a predetermined distance.

9. The speaker of claim 8, wherein the yoke is inserted into a yoke receiving opening formed in the speaker frame.

10. The speaker of claim 7, wherein the vibrating unit comprises: the voice coil unit having one end fixedly connected to the suspension to receive the electrical signals from the suspension and the other end connected to the magnetic field forming unit; and a vibrating plate connected to the suspension to vibrate together with the voice coil unit and connected to the speaker frame while allowing for vibrations thereof.

11. The speaker of claim 10, wherein the voice coil unit comprises: a coil bobbin having one end fixedly connected to the suspension and the other end disposed in a predetermined gap between a yoke and a magnet included in the magnetic field forming unit; and a voice coil wound on the coil bobbin and connected to the suspension to receive the electrical signals from the suspension.

12. The speaker of claim 10, wherein the vibration plate comprises: a first vibration plate connected to the suspension; and a second vibration plate connected to the first vibration plate and the speaker frame.

* * * * *